US006828870B2

(12) United States Patent
Hasegawa

(10) Patent No.: US 6,828,870 B2
(45) Date of Patent: Dec. 7, 2004

(54) NONRECIPROCAL CIRCUIT DEVICE HAVING A CASING COMPRISING TWO MEMBERS OF DIFFERENT THICKNESSES

(75) Inventor: Takashi Hasegawa, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 114 days.

(21) Appl. No.: 10/078,029

(22) Filed: Feb. 14, 2002

(65) Prior Publication Data

US 2002/0158703 A1 Oct. 31, 2002

(30) Foreign Application Priority Data

Feb. 16, 2001 (JP) ..... 2001-040857

(51) Int. Cl.[7] ..... H01P 1/32
(52) U.S. Cl. ..... 333/1.1; 333/24.2
(58) Field of Search ..... 333/1.1, 24.2

(56) References Cited

U.S. PATENT DOCUMENTS 4,749,965 A * 6/1988 Prevot et al. ..... 333/1.1
5,898,346 A 4/1999 Kamei et al. ..... 333/1.1
5,900,789 A * 5/1999 Yamamoto et al. ..... 333/1.1
6,011,449 A * 1/2000 Jussaume et al. ..... 333/1.1
6,060,958 A * 5/2000 Tokudera et al. ..... 333/1.1
6,278,666 B1 * 8/2001 Nakata et al. ..... 369/13.01

FOREIGN PATENT DOCUMENTS

JP 2000-114818 4/2000

OTHER PUBLICATIONS

Matsch, Leander W., "Electromagnetic and Electromechanical Machines", 1977, Harper and Row Publishers, 2nd edition, p. 12.*

* cited by examiner

*Primary Examiner*—Stephen E. Jones
(74) *Attorney, Agent, or Firm*—Keating & Bennett LLP

(57) ABSTRACT

A nonreciprocal circuit device includes a permanent magnet, a ferrite element to which a DC magnetic flux is applied by said permanent magnet, a plurality of center electrodes provided on the ferrite element, an upper casing member, and a lower casing member. The upper and lower casing members accommodate the permanent magnet, the ferrite element, and the center electrodes. The thickness of the lower casing member is set to the range between 50% and 100% of the thickness of the upper casing member. The upper and lower casing members are made of an iron-based metal.

20 Claims, 9 Drawing Sheets

NONRECIPROCAL CIRCUIT DEVICE HAVING A CASING COMPRISING TWO MEMBERS OF DIFFERENT THICKNESSES

BACKGROUND OF THE INVENTION

1. Field of the Invention

The present invention relates to a nonreciprocal circuit device and a communication apparatus using the same.

2. Description of the Related Art

In general, a nonreciprocal circuit device such as a lumped-constant isolator serves to pass signals only in a transmission direction and to block signals in the opposite direction. Such a type of isolator will be described with reference to FIGS. 13 and 14. As shown, an isolator 200 includes a permanent magnet 209, a ferrite element 210 to which a DC magnetic flux is applied by the permanent magnet 209, a plurality of center electrodes 220 provided on the ferrite element 210, and matching capacitance elements C connected to respective ends of the center electrodes 220. The isolator 200 also has an upper casing member 208 and a lower casing member 204 which are made of magnetic metal and which accommodate the permanent magnet 209, the ferrite element 210, the center electrodes 220, and the matching capacitance elements C. The upper casing member 208 and the lower casing member 204 are configured to have the same thickness t (typically 0.2 mm).

As shown in FIGS. 15 and 16, in the isolator 200, the permanent magnet 209, the ferrite element 210, the upper casing member 208, and the lower casing member 204 constitute a magnetic circuit. The DC magnetic flux is uniformly applied by the permanent magnet 209 to the ferrite element 210.

While such an isolator 200 has been successfully incorporated in a mobile communication apparatus such as a portable telephone, there is a need for further reduction in size.

SUMMARY OF THE INVENTION

Accordingly, the present invention provides a nonreciprocal circuit device that is reduced in size and particularly in height.

To this end, according to a first aspect of the present invention, there is provided a nonreciprocal circuit device. The nonreciprocal circuit device includes a permanent magnet, a ferrite element to which a DC magnetic flux is applied by the permanent magnet, and a plurality of center electrodes provided on the ferrite element. The nonreciprocal circuit device further includes a metal casing which is made of an iron-based metal and which accommodates the permanent magnet, the ferrite element, and the center electrodes. The metal casing includes a first casing member and a second casing member. The first casing member and the permanent magnet are in magnetic contact with each other. The thickness of the second casing member is in the range between 50% and 100% of the thickness of the first casing member.

With this arrangement, almost the entire DC magnetic flux of the permanent magnet flows through the first casing member that is in magnetic contact with the permanent magnet. The term "magnetic contact" herein refers to the case in which the permanent magnet is in direct contact with the first casing member as well as the case in which the permanent magnet is attached to the first casing member by means of an adhesive (non-magnetic material) or the like.

On the other hand, only part of the DC magnetic flux of the permanent magnet flows through the second casing member that is not in magnetic contact with the permanent magnet, due to the occurrence of a leakage flux. Thus, the thickness of the second casing member can be reduced to be within the range between 50% and 100% of the thickness of the first casing member, that is, within the range in which the DC magnetic flux flowing through the second casing member is not saturated. This arrangement, therefore, can provide a nonreciprocal circuit device that is reduced in size and particularly in height.

In one form of the invention, the second casing member has a pair of second casing sidewalls that oppose each other. In this case, the end surfaces of the first casing member are butted and joined to the sidewalls of the second casing member. Since the first casing member has no sidewalls, this arrangement can reduce the width of the nonreciprocal circuit device.

In another form of the invention, the first casing member has a pair of first casing sidewalls that oppose each other, and the second casing member has a pair of second casing sidewalls that oppose each other. In this case, the first casing sidewalls and the second casing sidewalls are overlapped and joined to each other. This arrangement can facilitate the assembly of the nonreciprocal circuit device and can stabilize the positional relationship of the first and second casing members after assembly. This arrangement, therefore, can provide a nonreciprocal circuit device with improved frequency characteristics.

Preferably, the nonreciprocal circuit device further includes a resin casing member which is incorporated in the metal casing and which accommodates the ferrite element and the center electrodes. The resin casing member has contact-preventing portions that extend therefrom. Each of the contact-preventing portions is provided between the inner surfaces of the first and second casing sidewalls and the peripheral surface of the permanent magnet. Thus, the contact between the inner surfaces of the sidewalls of the metal casing and the peripheral surface of the permanent magnet can be prevented. This arrangement, therefore, stabilizes the magnetic field distribution formed by the permanent magnet, that is, the DC magnetic flux applied to the ferrite element, which can provide a nonreciprocal circuit device with stable electric characteristics.

Preferably, the second casing member and the resin casing member are integrally formed. This arrangement can provide an enhanced accuracy in positioning the resin casing member relative to the second casing member, allowing improvements in the assembly characteristics and the assembly efficiency of the nonreciprocal circuit device.

Preferably, the first casing member and the second casing member are joined by welding. This improves the efficiency of the magnetic circuit formed in the metal casing, allowing a reduction in size of the metal casing. This arrangement, therefore, can provide a nonreciprocal circuit device that is reduced in size.

Preferably, the surfaces of at least one of the first casing member and the second casing member are plated with one of nickel and copper, and the plated surfaces are plated with silver. Nickel plating, copper plating, or silver plating improves the joining strength between the first casing member and the second casing member. Silver plating can also reduce the losses due to the high frequency current flowing through the metal casing, due to its high electric conductivity. This arrangement, therefore, can provide a nonreciprocal circuit device with improved frequency characteristics.

According to another aspect of the present invention, there is provided a communication apparatus. Since this communication apparatus includes the nonreciprocal circuit according the present invention, it has the same advantages as those of the nonreciprocal circuit device according to the present invention.

DESCRIPTION OF EMBODIMENTS OF THE INVENTION

Figure 1:
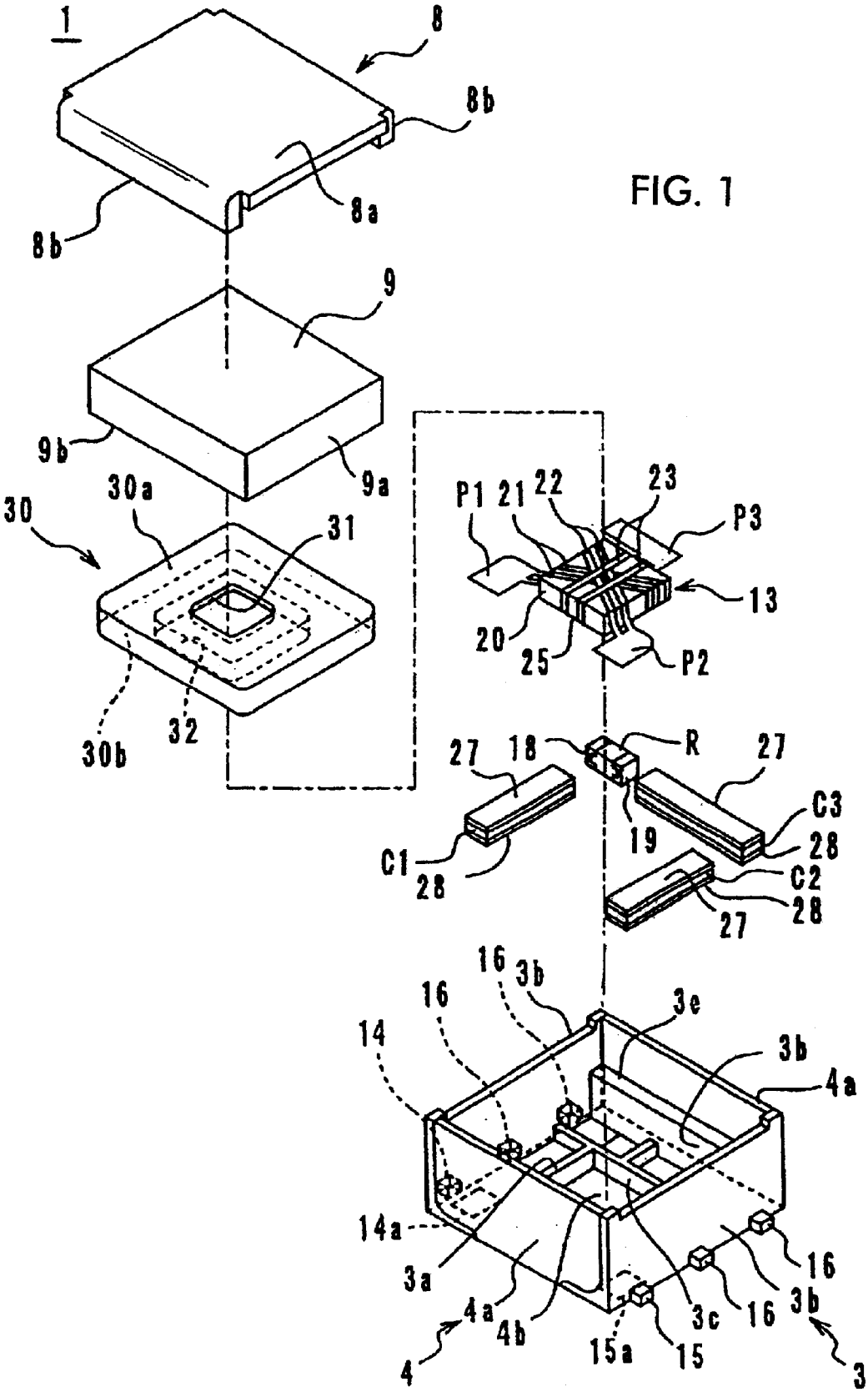
FIG. 1 is an exploded perspective view of a nonreciprocal circuit device according to a first embodiment of the present invention.

Nonreciprocal circuit devices and a communication apparatus will be described below in conjunction with embodiments according to the present invention, with references being made to the accompanying drawings. Throughout the embodiments, similar elements and portions are denoted with the same reference numerals and the description thereof will be omitted for simplicity.

Figure 2:
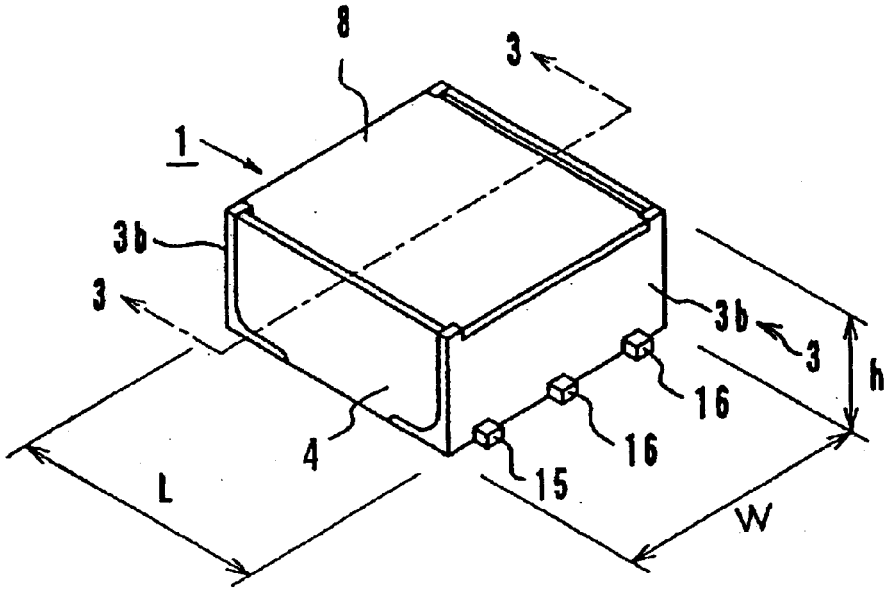
FIG. 2 is a perspective view of the nonreciprocal circuit device, after assembly, of the first embodiment.

A nonreciprocal circuit device according to a first embodiment of the present invention will be described below with reference to FIGS. 1 to 7. FIG. 1 is an exploded perspective view of the nonreciprocal circuit according to the first embodiment, and FIG. 2 is a perspective view of the nonreciprocal circuit device after assembly. The nonreciprocal circuit device according to the present invention will be explained herein as a lumped-constant isolator 1.

Figure 13:
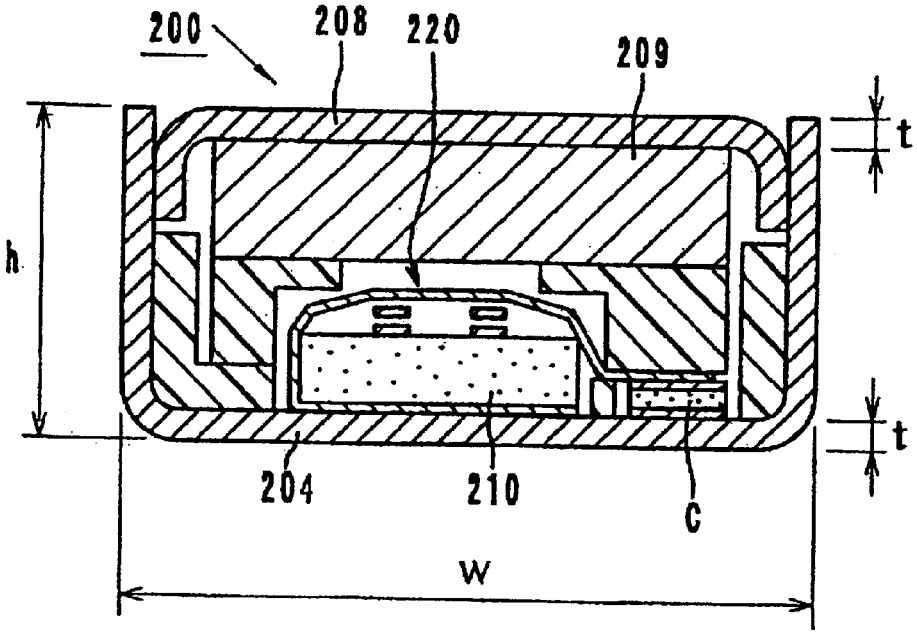
FIG. 13 PRIOR ART
FIG. 13 is a vertical sectional view of a first known nonreciprocal circuit device.
Figure 14:
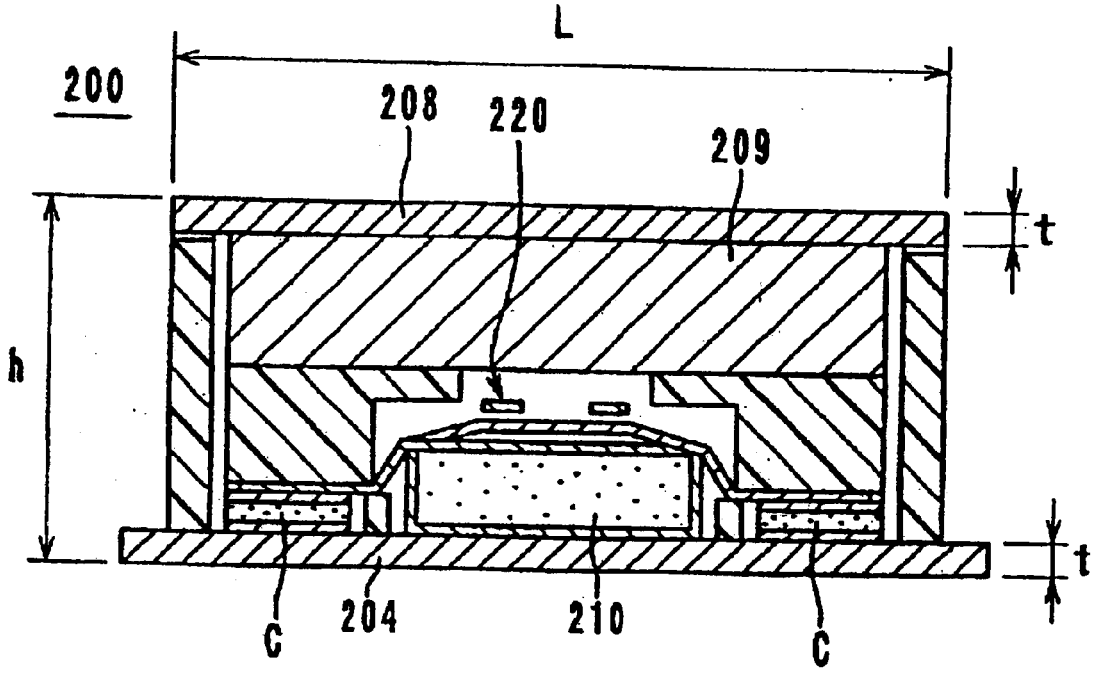
FIG. 14 PRIOR ART
FIG. 14 is a vertical sectional view of a second known nonreciprocal circuit device.

Referring first to FIG. 1, the lumped-constant isolator (hereinafter referred to as an "isolator") 1 includes an upper casing member 8, a lower casing member 4, a resin casing member 3, a center electrode assembly 13, a permanent magnet 9, a resistance element R, matching capacitance elements C1 to C3, and a resin member 30. The isolator 1 is similar to the isolator 200 of the related art, but the lower casing member 4 has a thickness smaller than the thickness t (refer to FIGS. 13 and 14) of the lower casing member 204 of the isolator 200.

The permanent magnet 9 has a substantially rectangular shape in plan view and is made of magnetized ferrite. The permanent magnet 9 that is made of magnetized ferrite has a small dielectric loss and a small magnetic loss in frequency bands of 100 MHz to 3 GHz, and can provide a sufficient magnetic force to the isolator 1 for operating in those frequency bands. The permanent magnet 9 is in direct contact with the ceiling of the upper casing member 8.

The center electrode assembly 13 is configured in such a manner that center electrodes 21 to 23 are arranged so as to cross one another at substantially 120° angles on the upper surface of a microwave ferrite element 20, which has a generally rectangular shape in plan view, with an insulating sheet (not shown) interposed therebetween. One end of each of the center electrodes 21 to 23 has a respective port P1 to P3 extending horizontally therefrom. That is, the center electrodes 21 to 23 and the insulating sheet are stacked on the upper center portion of the ferrite element 20. The other ends of the center electrodes 21 to 23 are connected to a common ground electrode 25, which is provided to cover almost the entire bottom surface of the ferrite element 20. The center electrodes 21 to 23 and the ground electrode 25 are made of conductive material and are integrally formed by stamping or etching a metal sheet.

The matching capacitance elements C1 to C3 each have a hot-side terminal electrode 27 provided on the upper surface of a dielectric ceramic substrate and a cold-side (grounding-side) terminal electrode 28 provided on the bottom surface thereof.

The resistance element R is configured such that a grounding-side terminal electrode 18 and a hot-side terminal electrode 19 are respectively provided on the both ends of an insulating substrate with resistance members interposed therebetween.

The lower casing member 4 has a bottom wall 4*b* and a pair of opposing sidewalls 4*a*. Two ground terminals 16 extend from each of two opposing edges at the bottom wall 4*b* of the lower casing member 4. Thus, the bottom wall 4*b* of the lower casing member 4 and the ground terminals 16 are formed as one piece. The upper casing member 8 is rectangular in plan view and has two opposing sidewalls 8*b* that extend from the upper wall 8*a*, thus having a substantially inverted U-shape profile. The lower casing member 4 is integrally formed by insert molding in conjunction with the resin casing member 3, an input terminal 14, and an output terminal 15. This provides an enhanced accuracy in positioning the resin casing member 3 relative to the lower casing member 4, which can improve the assembly characteristics of the isolator 1.

The lower casing member 4 and the upper casing member 8 are each provided by stamping, bending and surfacetreating an SPCC plate. Since an iron-based metal such as SPCC is high in saturation magnetic flux density and thus improves the efficiency of a magnetic circuit formed in the casing members 4 and 8, it is suitable for reducing the size of the casing members 4 and 8. In the present invention, therefore, the thickness t4 of the lower casing member 4 is set to the range between 50% and 100% of the thickness t8 of the upper casing member 8 that is in direct contact with the permanent magnet 9.

The casing members 4 and 8 are surface-treated in such a manner that the surfaces thereof are plated with nickel or copper (typical plating thickness: 1 μm) and are further plated with silver (typical plating thickness: 4 μm). Silver plating provides a high electric conductivity and provides advantages of reducing the insertion loss of the isolator 1 as well as preventing rust. Nickel or copper plating has an advantage of increasing the joining strength between the silver plating and the base iron of the casing members 4 and 8. In particular, since nickel is a magnetic material, it has a higher saturation magnetic flux density than copper Thus, the efficiency of the magnetic circuit formed in the casing members 4 and 8 is improved, which can reduce the sizes of the casing members 4 and 8.

The resin casing member 3 has a box-like shape with a bottom wall 3*a* and sidewalls 3*b*. An opening 3*c* for accommodating the center electrode assembly 13 is formed at substantially the center of the bottom wall 3*a*. Openings 3*d* for accommodating respective matching capacitor elements C1 to C3 and the resistance element R are formed at the periphery of the opening 3*c*. The bottom surfaces of the openings 3*c* and 3*d* are defined by the bottom wall 4*b* of the lower casing member 4. The input terminal 14 and the output terminal 15 each have one end exposed from the outer surface of the resin casing member 3. The other ends of the input terminal 14 and the output terminal 15 are exposed from the bottom wall 3*a* of the resin casing member 3 so as to serve as an input-lead electrode 14*a* and an output-lead electrode 15*a,* respectively.

Figure 3:
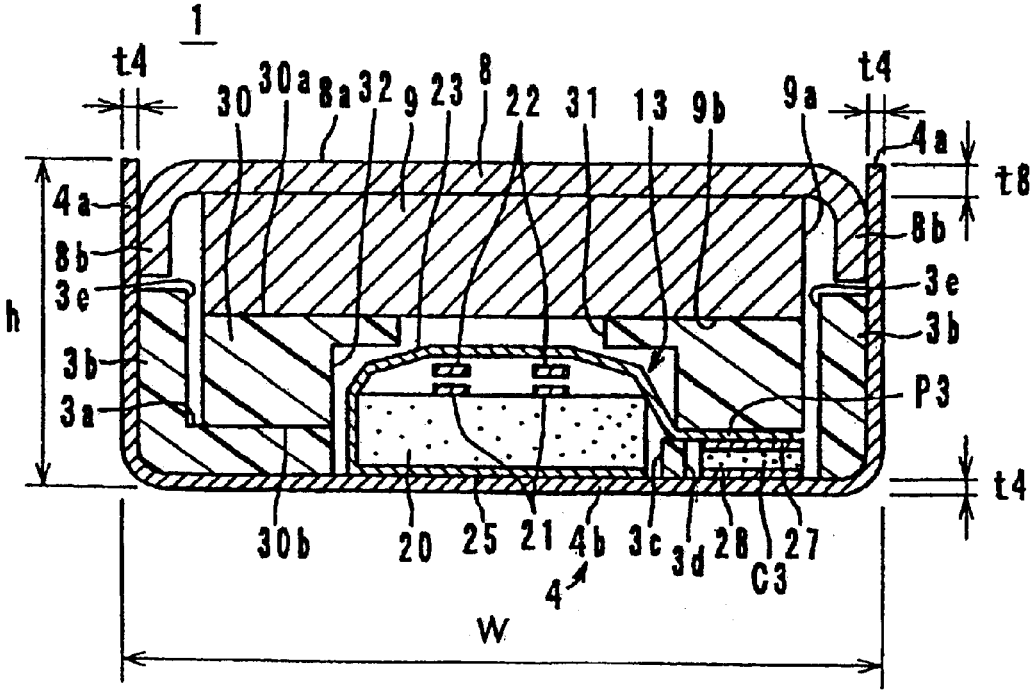
FIG. 3 is a vertical sectional view of the nonreciprocal circuit device of the first embodiment, taken along line 3—3 in FIG. 2.

Contact-preventing portions 3*e* extend from the edges of the sidewalls 3*b* of the resin casing member 3. Referring to FIG. 3, preferably, the thickness of the contact-preventing portions 3*e* is greater than the thickness t8 of the upper casing member 8, and when the permanent magnet 9 is incorporated in the resin casing member 3, the upper surfaces of the contact-preventing portions 3*e* are arranged to be higher than the bottom surface 9*b* of the permanent magnet 9. Without such an arrangement, if the peripheral surface 9*a* of the permanent magnet 9 is brought into contact with the sidewall 8*b* of the upper casing member 8, the magnetic circuit is short-circuited at the point of contact, thereby causing a disturbance and/or weakening of the DC magnetic flux of the permanent magnet 9. This arrangement, therefore, is intended for avoiding such an inconvenience.

The resin member 30 has a substantially rectangular shape in plan view, and the bottom surface 30*b* thereof is provided with a recess 32 for accommodating the center electrode assembly 13 so that the height of the isolator 1 is reduced. In the center portion of the recess 32, a penetrating opening 31 is formed for accommodating the stacked center electrodes 21 to 23 and the related elements. A liquid crystal polymer or polyphenylene sulfide resin is preferably used as a material for the resin member 30 and the resin casing member 3, because they exhibit a high thermal resistance property and a low loss property.

The elements described above are assembled in the following manner. The matching capacitance elements C1 to C3, the resistance elements R, and the center electrode assembly 13 are accommodated in the corresponding openings 3*c* and 3*d* of the resin casing member 3 that is integrally formed with the lower casing member 4.

The center electrode assembly 13 is connected by soldering, for example, to the bottom wall 4*b* of the lower casing member 4 which defines the bottom surface of the opening 3*c,* and is grounded. The port P1 of the center electrode 21 and the port P2 of the center electrode 22 are soldered to the input-lead electrode 14*a* and the output-lead electrode 15*a,* respectively. The hot-side terminal electrode 19 of the resistance element R is soldered to the port P3, and the grounding-side terminal electrode 18 is soldered to the bottom wall 4*b* of the lower casing member 4 which defines the bottom surfaces of the openings 3*d* of the resin casing member 3. Thus, as shown in FIG. 4, the matching capacitor element C3 and the resistance element R are electrically connected in parallel between the port P3 of the center electrode 23 and the ground terminal 16.

Figure 6:
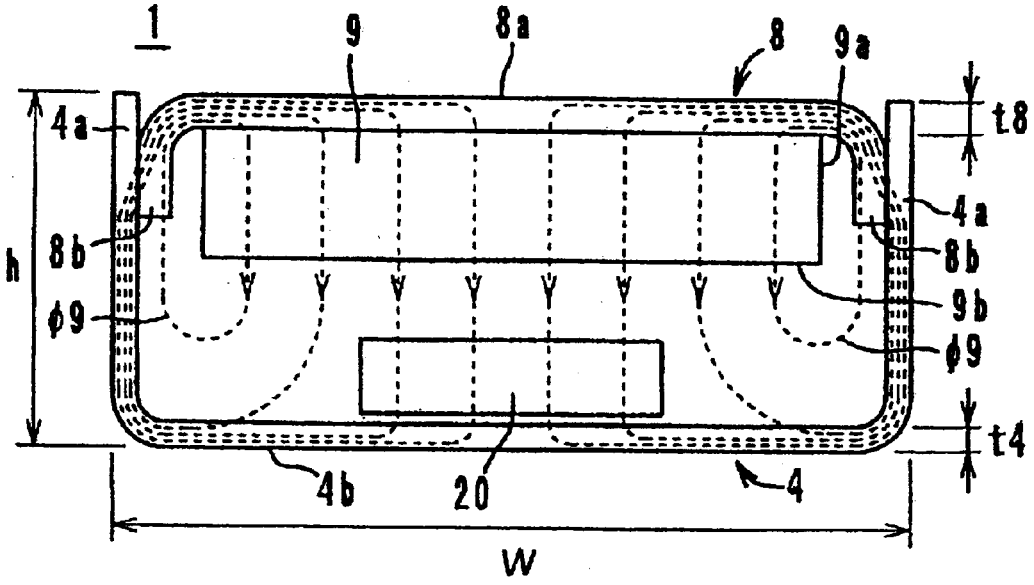
FIG. 6 is a vertical sectional view illustrating the flow of the magnetic flux in the nonreciprocal circuit device according to the first embodiment with a casing thickness ratio of 50%.

In addition, the resin member 30 is accommodated in the resin casing member 3, the permanent magnet 9 is arranged on the upper surface 30*a* of the resin member 30, and then the upper casing member 8 is mounted thereon. The permanent magnet 9 and the upper wall 8*a* of the upper casing member 8 are in direct and magnetic contact with each other. In this case, as shown in FIG. 3, the contact-preventing portions 3*e* lie between the peripheral surface 9*a* of the permanent magnet 9 and the sidewalls 4*a* of the lower casing member 4, respectively, so as to prevent the contact of the permanent magnet 9 and the sidewalls 8*b*. As shown in FIG. 6, the permanent magnet 9 applies the DC magnetic flux to the center electrode assembly 13. The lower casing member 4 and the upper casing member 8 are joined into a single metal casing, which constitutes the magnetic circuit and also serves as a yoke. Additionally, the metal casing is electrically connected to the ground terminal 16, so that it has a ground potential and also serves as a shield for preventing electromagnetic wave emission.

The lower casing member 4 and the upper casing member 8 are assembled such that the respective sidewalls 4*a* and 8*b* are overlapped and joined. This facilitates the assembly of the isolator 1, and stabilizes the positional relationship between the lower casing member 4 and the upper casing member 8 after assembly. Resistance welding, laser welding, arc welding, soldering, an adhesive resin, or the like is used to join the sidewalls 4*a* and 8*b*. When solder or an adhesive resin is employed to join them, magnetic circuit gaps due to the solder or adhesive resin are generated at the joined portions. In contrast, when welding is used to join the sidewalls 4*a* and 8*b,* no magnetic circuit gap is generated at the joined portions. Thus, the use of welding can reduce the magnetic resistances of the joined portions of the casing members 4 and 8. This improves the efficiency of the magnetic circuit, which makes it possible to reduce the height of the permanent magnet 9.

Figure 4:
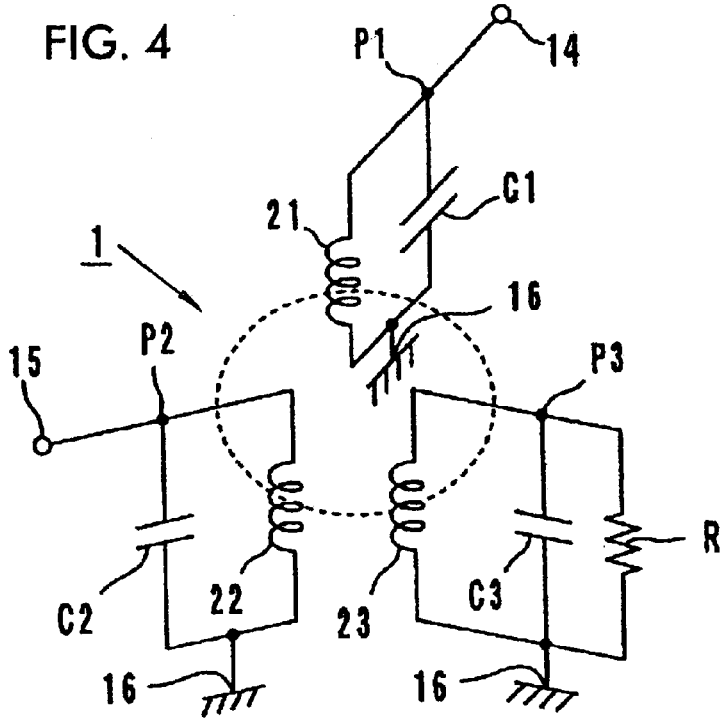
FIG. 4 is an equivalent circuit diagram of the nonreciprocal circuit device of the first embodiment.

In such a manner, the isolator 1 shown in FIGS. 2 to 4 is assembled. FIG. 3 is a vertical sectional view, taken along line 3—3 in FIG. 2, of the isolator 1, and FIG. 4 is an equivalent circuit diagram of the isolator 1.

Figure 5:
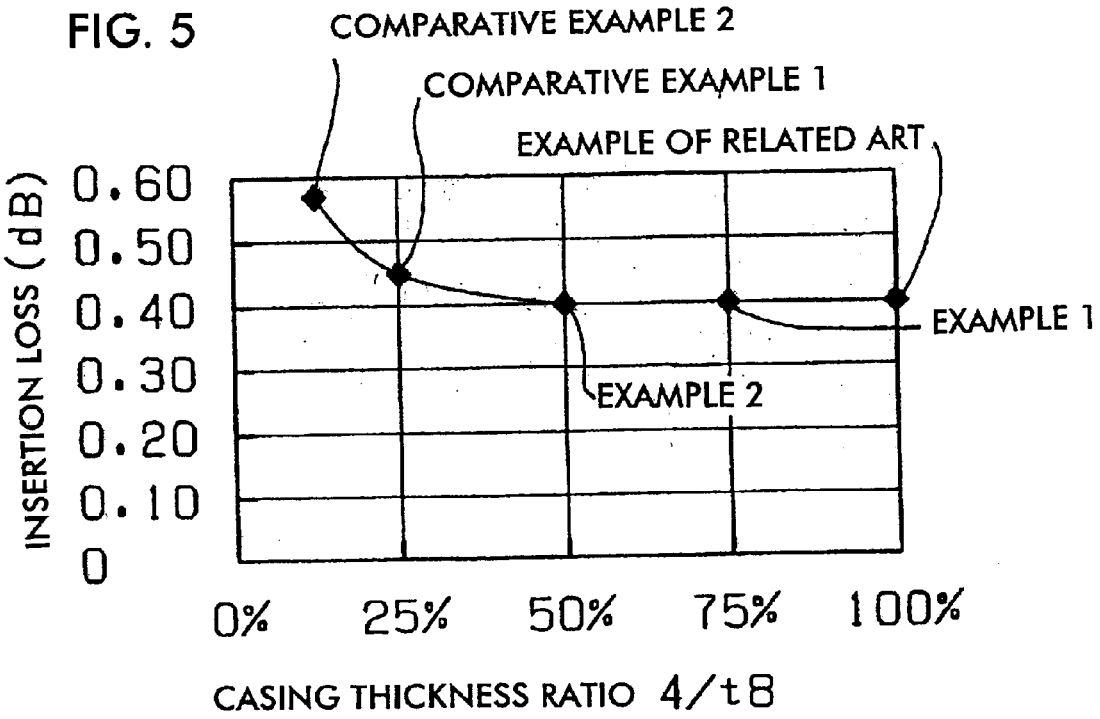
FIG. 5 is a graph illustrating the relationship between the casing thickness ratios and the insertion losses of the nonreciprocal circuit devices.

The measurements of insertion losses when the isolator 1 is used in a frequency band of 2 GHz are shown in Table 1, in which the thickness t8 (see FIG. 3) of the upper casing member 8 is fixed at 0.20 mm, and the thickness t4 of the lower casing member 4 is changed to various values. In Table 1, the "casing thickness ratio" represents the ratio of the thickness t4 of the lower casing member 4 to the thickness t8 of the upper casing member 8, that is, the percentage of (thickness t4)/(thickness t8). The "volume ratio" represents the ratio of the volume of the respective isolators to the volume of the isolator 200 of the related art, that is, to the volume of width w (4.00 mm)×length L (4.00 mm)×height h (1.90 mm). In other words, the "volume ratio" represents the percentage of (volume of each isolator)/(volume of the isolator of the related art). FIG. 5 illustrates the relationships between the casing thickness ratios and insertion losses which are shown in Table 1.

TABLE 1

| | Thickness T4 (mm) | Thickness T8 (mm) | Casing thickness ratio | Width w (mm) | Length L (mm) | Height h (mm) | Volume ratio | Insertion loss (dB) |
|---|---|---|---|---|---|---|---|---|
| Example 1 | 0.15 | 0.20 | 75% | 3.90 | 4.00 | 1.85 | 95% | 0.40 |
| Example 2 | 0.10 | 0.20 | 50% | 3.80 | 4.00 | 1.80 | 90% | 0.40 |
| *Comparative Example 1 | 0.05 | 0.20 | 25% | 3.70 | 4.00 | 1.75 | 86% | 0.45 |
| *Comparative Example 2 | 0.025 | 0.20 | 12.5% | 3.65 | 4.00 | 1.725 | 83% | 0.57 |
| *Example of Related art | 0.20 | 0.20 | 100% | 4.00 | 4.00 | 1.90 | 100% | 0.40 |

Examples indicated with an asterisk (*) are beyond the scope of the present invention.

As can been seen from Table 1 and FIG. 5, when the casing thickness ratio is in the range between 50% and 100%, the insertion loss of the isolator 1 is almost the same as that of the isolator 200 of the related art, while the height h and the volume ratio are smaller than those of the isolator 200. In contrast, when the casing thickness ratio is below 50%, the insertion loss of the isolator becomes large. Accordingly, when the casing thickness ratio is in the range between 50% and 100%, it is possible to reduce the size and height of the isolator without sacrificing the insertion loss.

Figure 7:
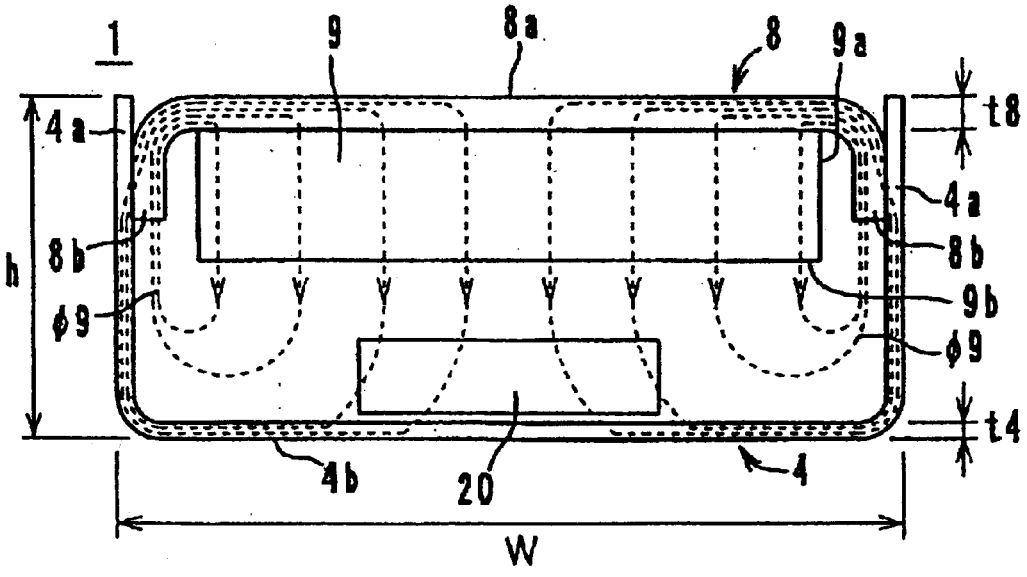
FIG. 7 is a vertical sectional view illustrating the flow of the magnetic flux in a nonreciprocal circuit device with a casing thickness ratio of 25% for the purpose of comparison.
Figure 15:
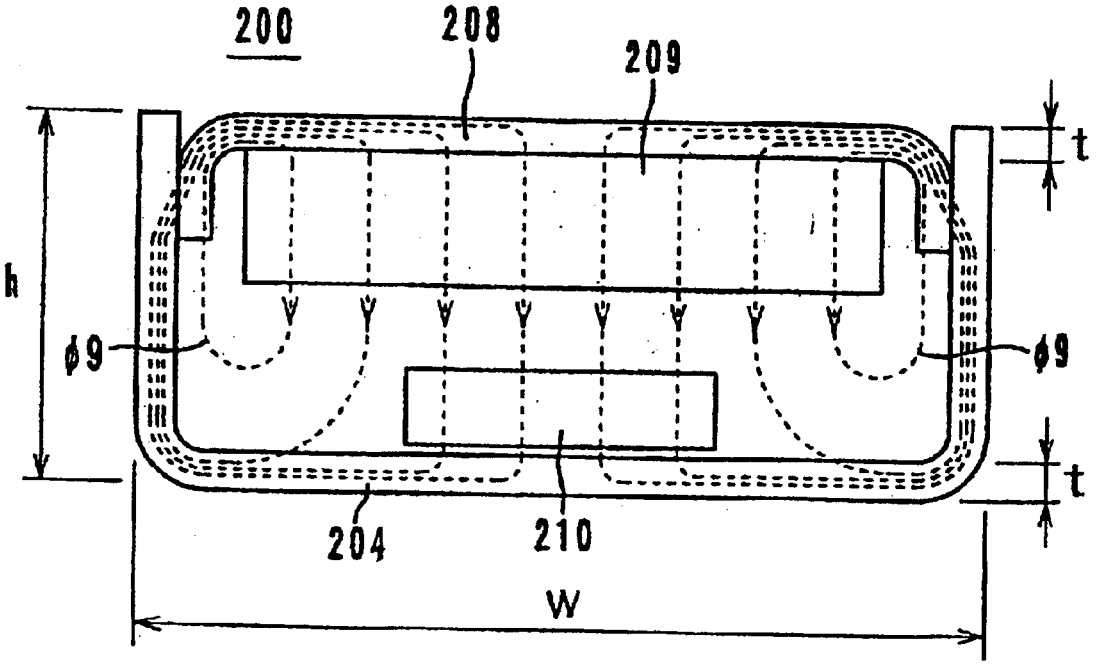
FIG. 15 PRIOR ART
FIG. 15 is a vertical sectional view illustrating the flow of the magnetic flux in the first known nonreciprocal circuit device.
Figure 16:
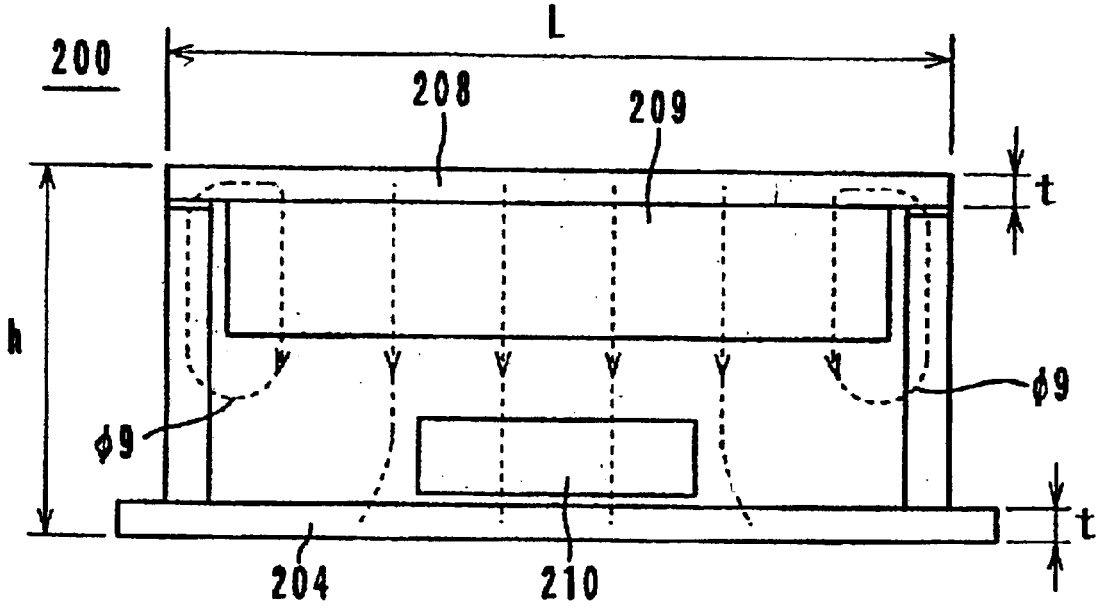
FIG. 16 PRIOR ART
FIG. 16 is a vertical sectional view illustrating the flow of the magnetic flux in the second known nonreciprocal circuit device.

The reason why the insertion loss is not sacrificed when the casing thickness ratio is in the range between 50% and 100% will now be described. FIG. 6 illustrates the flow of a magnetic flux in the isolator 1 of example 2 with the casing thickness ratio of 50% shown in Table 1. FIG. 7 illustrates the flow of a magnetic flux in comparative example 1 with the casing thickness ratio of 25% shown in Table 1. FIGS. 15 and 16 illustrate the flow of a magnetic flux in the isolator 200 of the related art which has the casing thickness ratio of 100% shown in Table 1.

In the isolator 200 of the related art, as shown in FIGS. 15 and 16, almost the entire magnetic flux of the permanent magnet 209 flows through the upper casing member 208 that is in direct contact with the permanent magnet 209. On the other hand, through the lower casing member 204 that is not in direct contact with the permanent magnet 209, only part of the magnetic flux of the permanent magnet 209 flows due to the occurrence of a leakage flux ϕ9. Thus, the thickness t of the lower casing member 204 can be reduced until the density of the magnetic flux flowing through the lower casing member 204 reaches its saturation density.

Accordingly, as in the isolator of example 2, the thickness t4 of the lower casing member 4 is reduced to 0.1 mm, that is, to 50% in the casing thickness ratio. Even in this case, as shown in FIG. 6, the density of the magnetic flux flowing through the lower casing member 4 does not reach its saturation density; therefore, the magnetic field distribution formed by the permanent magnet 9 is the same as in the isolator 200 (see FIG. 15). Thus, the isolator 1 of example 2 and the isolator 200 of the related art have the same insertion loss.

However, as in the isolator of comparative example 1 shown in Table 1, when the thickness t4 of the lower casing member 4 is further reduced to 0.05 mm such that the casing thickness ratio becomes 25%, as shown in FIG. 7, the magnetic flux flowing through the lower casing member 4 is saturated. Thus, the leakage flux ϕ9 is increased, so that the magnetic field distribution formed by the permanent magnet 9 varies. This results in a higher magnetic flux density at the center portion of the ferrite element 20 and a lower magnetic flux density at the peripheral portion thereof, so that the density of magnetic flux applied to the ferrite element 20 becomes non-uniform. Consequently, the magnetic coupling among the center electrodes 21 to 23 via the ferrite element 20 becomes weak and the insertion loss of the isolator is increased.

In the isolator 1 according to the first embodiment, almost the entire DC magnetic flux of the permanent magnet 9 flows through the upper casing member 8 that is in magnetic contact with the permanent magnet 9. On the other hand, through the lower casing member 4 that is not in magnetic contact with the permanent magnet 9, only part of the DC magnetic flux of the permanent magnet 9 flows due to the occurrence of the leakage flux ϕ9. Thus, the thickness t4 of the lower casing member 4 can be reduced in the range in which the magnetic flux flowing through the lower casing member 4 is not saturated, that is, in the range between 50% and 100% of the thickness t8 of the upper casing member 8. The present invention, therefore, can provide an isolator that is reduced in size and particularly in height.

Figure 8:
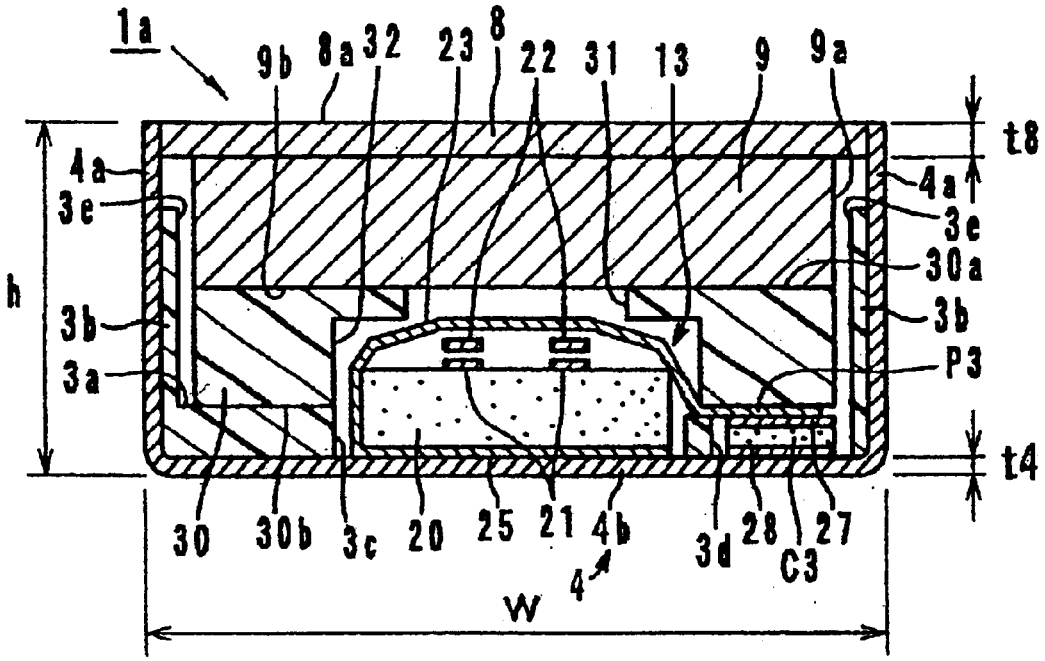
FIG. 8 is a vertical sectional view of a nonreciprocal circuit device according to a second embodiment of the present invention.

An isolator 1*a* according to a second embodiment will now be described with reference to FIG. 8. As shown, in the isolator 1*a,* the sidewalls 8*b* of the upper casing member 8 are eliminated. Thus, the upper casing member 8 has a flat plate shape and has no sidewalls. Two opposing ends of the upper casing member 8 and the two opposing sidewalls 4*a* of the lower casing member 4 are joined to each other to constitute a metal casing.

This isolator 1*a* provides the same advantage as in the first embodiment. In addition, since the upper casing member 8 has no sidewalls that overlap with the sidewalls 4*a* of the lower casing member 4, a thickness equivalent to the two sidewalls 8*b,* that is, twice the thickness t8 of the upper casing member 8 can be saved. Thus, the width w can be reduced according to the saved space, which can provide an isolator that is reduced in size.

Figure 9:
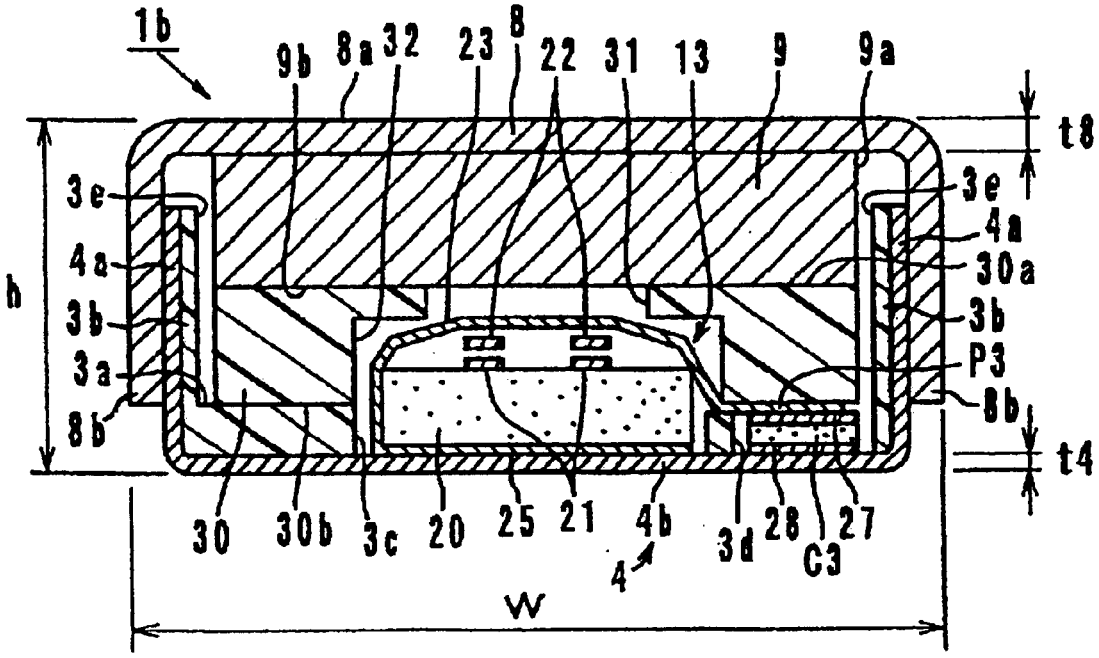
FIG. 9 is a vertical sectional view of a nonreciprocal circuit device according to a third embodiment of the present invention.

An isolator 1*b* according to a third embodiment will now be described with reference to FIG. 9. As shown, in the isolator 1*b,* the sidewalls 8*b* of the upper casing member 8 are arranged outside the sidewalls 4*a* of the lower casing member 4, and sidewalls 4*a* and 8*b* are joined. Thus, the sidewalls 8*b* of the upper casing member 8 do not necessarily have to be arranged inside the sidewalls 4*a* of the lower casing member 4. This isolator 1*b* provides the same advantage as in the first embodiment. In addition, this isolator 1*b* can have an increased overlapping area, that is, the joining area of the sidewalls 4*a* and sidewalls 8*b*. This allows a decrease in the magnetic resistance, thus increasing the efficiency of the magnetic circuit formed in the lower and upper casing members 4 and 8. It is therefore possible to reduce the size of the casing members 4 and 8 and to provide an isolator that is reduced in size.

The contact-preventing portions 3*e* extend from the sidewalls 3*b* of the resin casing member 3 to substantially the same height of the sidewalls 4*a* of the lower casing member 4 so as to cover substantially the entire inner surface of the sidewalls 4*a*. Thus, the contact-preventing portions 3*e* are arranged, respectively, between the inner surfaces of the sidewalls 8*b* and 4*a* of the upper and lower casing members 8 and 4 and the peripheral surface 9*a* of the permanent magnet 9. This arrangement can prevent the contact between the inner surfaces of the sidewalls 4*a* and 8*b* and the peripheral surface 9*a* of the permanent magnet 9.

Figure 10:
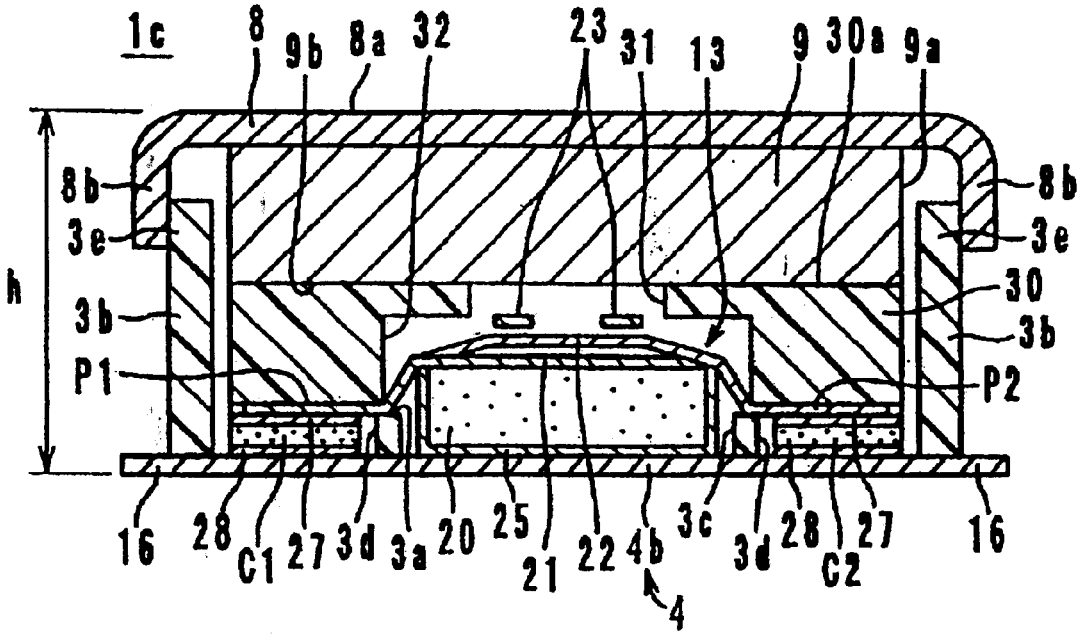
FIG. 10 is a vertical sectional view of a nonreciprocal circuit device according to a fourth embodiment of the present invention.

An isolator 1*c* according to a fourth embodiment will now be described with reference to FIGS. 10 and 11. In the isolator 1*c*, the sidewalls 8*b* are formed at all four sides of the upper wall 8*a* of the upper casing member 8. That is, the upper casing member 8 is not limited to an inverted U-shape or plate shape. The upper casing member 8 is disposed and fixed on the resin casing member 3 which is disposed on the lower casing member 4. The lower casing member 4 includes a bottom wall 4*b* and ground terminals 16.

Figure 11:
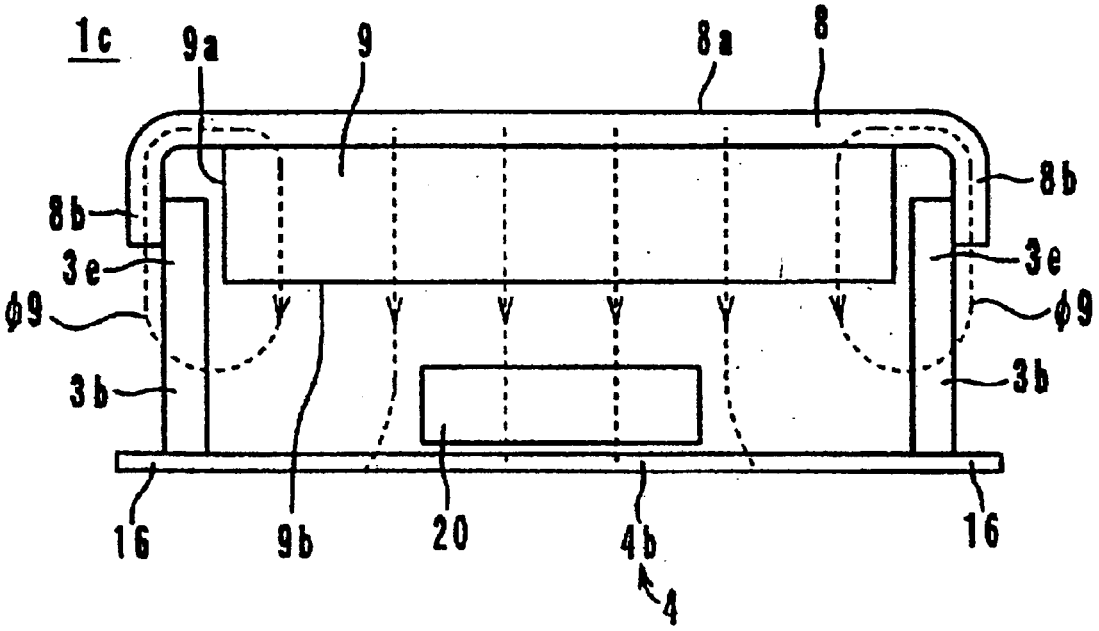
FIG. 11 is a vertical sectional view illustrating the flow of the magnetic flux in the nonreciprocal circuit device according to the fourth embodiment.

As shown in FIG. 11, even if the magnetic flux formed by the permanent magnet 9 flows into the lower casing member 4, a uniform DC magnetic flux is applied by the permanent magnet 9 to the ferrite element 20 because no magnetic flux is saturated in the lower casing member 4. This isolator 1*c* provides the same advantage as in the first embodiment.

A communication apparatus according to a fifth embodiment of the present invention will be described below in the context of a portable telephone with reference to FIG. 12.

Figure 12:
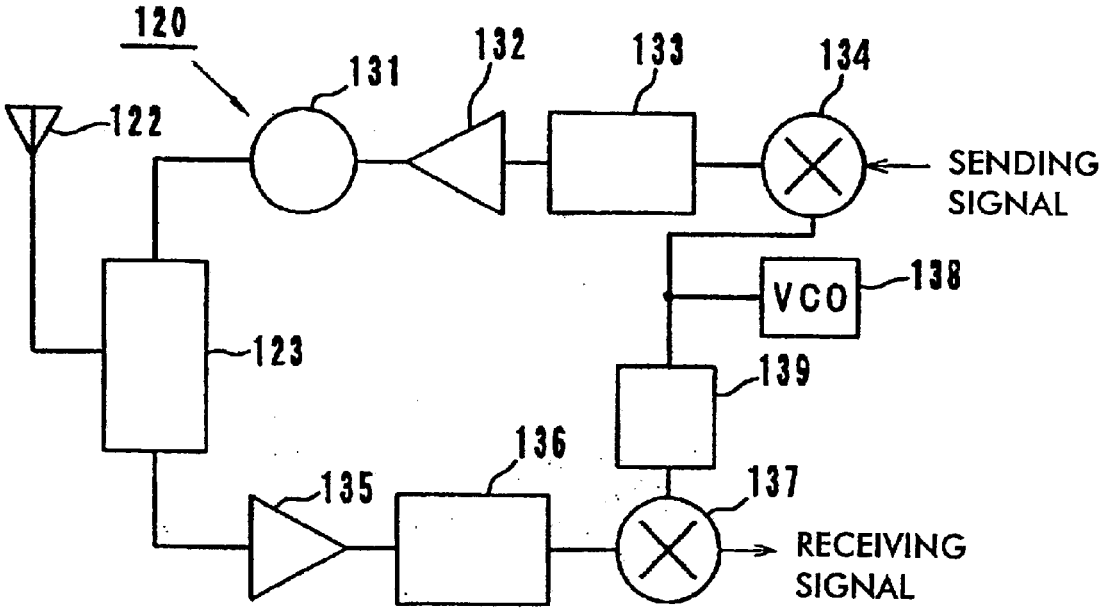
FIG. 12 is a block diagram of a communication apparatus according to one embodiment of the present invention.

FIG. 12 is an electrical circuit block diagram of the RF section of a portable telephone 120. As shown, the portable telephone 120 includes an antenna element 122, a duplexer 123, a sending-side isolator 131, a sending-side amplifier 132, a sending-side interstage bandpass filter 133, a sending-side mixer 134, a receiving-side amplifier 135, receiving-side interstage bandpass filter 136, a receiving-side mixer 137, a voltage-controlled oscillator (VCO) 138, and a local bandpass filter 139.

Any one of the isolators 1, 1*a*, 1*b*, 1*c* of the first to fourth embodiments can be used as the sending-side isolator 131. Implementing one of the isolators 1, 1*a*, 1*b*, 1*c* as the sending-side isolator 131 can achieve a smaller portable telephone with a low profile.

While the lower casing member 4 and the resin casing member 3 have been described as being integrally formed, the present invention is not limited thereto. For example, the lower casing member 4 and the lower casing member 3 may be separately formed and then combined.

While the present invention has been applied to an isolator in the embodiments described above, the present invention is also naturally applicable to a circulator. In addition, the crossing angles among the respective center electrodes 21 to 23 may be in the range between 110° and 140°. Additionally, the ferrite element 20, the permanent magnet 9, and the resin member 30 are not limited to a rectangular shape in plan view, but can take any shape such as a circle, a triangle with rounded comers, an irregular polygon, or the like.

Although the present invention has been described in connection with particular embodiments thereof, the present invention is not limited thereto and can take various forms within the fair spirit and scope of the present invention.

What is claimed is:

1. A nonreciprocal circuit device comprising:

a permanent magnet;

a ferrite element to which a DC magnetic flux is applied by said permanent magnet;

a plurality of center electrodes provided on said ferrite element; and a metal casing including a base material which is made of an iron-based metal and which accommodates said permanent magnet, said ferrite element, and said center electrodes, wherein said metal casing comprises a first casing member and a second casing member, the first casing member and said permanent magnet are in magnetic contact with each other, and the base material of the second casing member has a thickness greater than 50% and substantially less than 100% of a thickness of the base material of the first casing member.

2. A nonreciprocal circuit device according to claim 1, wherein the second casing member comprises a pair of second casing sidewalls that oppose each other.

3. A nonreciprocal circuit device according to claim 1, wherein the second casing member comprises a first pair of second casing sidewalls that oppose each other, and a second pair of second casing sidewalls that oppose each other.

4. A nonreciprocal circuit device according to claim 1, wherein the first casing member comprises a pair of first casing sidewalls that oppose each other, and the second casing member comprises a pair of second casing sidewalls that oppose each other, the first casing sidewalls and the second casing sidewalls being overlapped and joined to each other.

5. A nonreciprocal circuit device according to claim 4, further comprising a resin casing member which is incorporated in said metal casing and which accommodates said ferrite element and said center electrodes, said resin casing member having contact-preventing portions provided between respective inner surfaces of the first and second casing sidewalls and a peripheral surface of said permanent magnet.

6. A nonreciprocal circuit device according to claim 5, wherein said resin casing member is insert-molded in said second casing member so as to integrally join the same.

7. A nonreciprocal circuit device according to claim 5, wherein said contact-preventing portions have upper surfaces which are extended to a location higher than a bottom surface of the magnet.

8. A nonreciprocal circuit device according to claim 7, wherein said contact-preventing portions cover substantially all of an inner surface of each first casing sidewall.

9. A nonreciprocal circuit device according to claim 4, wherein said second casing sidewalls overlap respective inner surfaces of the first casing sidewalls.

10. A nonreciprocal circuit device according to claim 9, further comprising a resin casing member which is incorporated in said metal casing and which accommodates said ferrite element and said center electrodes, said resin casing member having contact-preventing portions provided between respective inner surfaces of the first and second casing sidewalls and a peripheral surface of said permanent magnet.

11. A nonreciprocal circuit device according to claim 10, wherein said resin casing member is insert-molded in said second casing member so as to integrally join the same.

12. A nonreciprocal circuit device according to claim 4, wherein said second casing sidewalls overlap respective outer surfaces of the first casing sidewalls.

13. A nonreciprocal circuit device according to claim 1, wherein the first casing member and the second casing member are joined by welds.

14. A nonreciprocal circuit device according to claim 1, wherein at least one of the first casing member and the second casing member has plated surfaces comprising one of nickel and copper, and said plated surfaces are further plated with silver.

15. A nonreciprocal circuit device according to claim 14, wherein said plated surfaces consist essentially of nickel plated with silver.

16. A non reciprocal circuit device according to claim 1, wherein said DC magnetic flux is unsaturated in said second casing member.

17. A nonreciprocal circuit device according to claim 1, wherein said metal casing comprises cold rolled carbon steel.

18. A communication apparatus comprising at least one of a transmission circuit and a reception circuit, said circuit comprising the nonreciprocal circuit device according to claim 1.

19. A nonreciprocal circuit device comprising:

a permanent magnet;

a ferrite element to which a DC magnetic flux is applied by said permanent magnet;

a plurality of center electrodes provided on said ferrite element; and a metal casing including a base material which is made of an iron-based metal and which accommodates said permanent magnet, said ferrite element, and said center electrodes, wherein said metal casing comprises a first casing member and a second casing member, the first casing member and said permanent magnet are in magnetic contact with each other, and the base material of the second casing member as a thickness greater than 50% and substantially less than 100% of a thickness of the base material of the first casing member;

wherein the first casing member comprises a pair of first casing sidewalls that oppose each other, and the second casing member comprises a pair of second casing sidewalls that oppose each other, the first casing sidewalls and the second casing sidewalls being overlapped and joined to each other;

wherein a resin casing member is incorporated in said metal casing and accommodates said ferrite element and said center electrodes, said resin casing member having contact-preventing portions provided between respective inner surfaces of the first and second casing sidewalls and a peripheral surface of said permanent magnet; and wherein said contact-preventing portions have a thickness greater than that of the upper casing member, and have upper surfaces which are extended to a location higher than a bottom surface of the magnet.

20. A nonreciprocal circuit device comprising:

a permanent magnet;

a ferrite element to which a DC magnetic flux is applied by said permanent magnet;

a plurality of center electrodes provided on said ferrite element; and a metal casing including a base material which is made of an iron-based metal and which accommodates said permanent magnet, said ferrite element, and said center electrodes, wherein said metal casing comprises a first casing member and a second casing member, the first casing member and said permanent magnet are in magnetic contact with each other, and the base material of the second casing member has a thickness greater than 50% and substantially less than 100% of a thickness of the base material of the first casing member;

wherein the first casing member comprises a pair of first casing sidewalls that oppose each other, and the second casing member comprises a pair of second casing sidewalls that oppose each other, the first casing sidewalls and the second casing sidewalls being overlapped and joined to each other;

wherein said second casing sidewalls overlap respective inner surfaces of the first casing sidewalls;

wherein a resin casing member is incorporated in said metal casing and accommodates said ferrite element and said center electrodes, said resin casing member having contact-preventing portions provided between respective inner surfaces of the first and second casing sidewalls and a peripheral surface of said permanent magnet;

wherein said contact-preventing portions have a thickness greater than that of the upper casing member, and have upper surfaces which are extended to a location higher than a bottom surface of the magnet.

* * * * *